US010228133B1

(12) United States Patent
Akopian

(10) Patent No.: US 10,228,133 B1
(45) Date of Patent: Mar. 12, 2019

(54) FIRE STARTERS INCLUDING ROTATING PYROPHORIC RODS

(71) Applicant: Rouben Akopian, San Mateo, CA (US)

(72) Inventor: Rouben Akopian, San Mateo, CA (US)

( * ) Notice: Subject to any disclaimer, the term of this patent is extended or adjusted under 35 U.S.C. 154(b) by 180 days.

(21) Appl. No.: 15/264,853

(22) Filed: Sep. 14, 2016

Related U.S. Application Data

(60) Provisional application No. 62/218,410, filed on Sep. 14, 2015.

(51) Int. Cl.

| | |
|---|---|
| ***F23Q 2/32*** | (2006.01) |
| ***F23Q 1/02*** | (2006.01) |
| ***F23Q 1/06*** | (2006.01) |
| ***F23Q 1/00*** | (2006.01) |

(52) U.S. Cl.
CPC *F23Q 1/06* (2013.01); *F23Q 1/00* (2013.01)

(58) Field of Classification Search
CPC ..... F23D 11/42; F23D 2207/00; F23Q 2/46
USPC ..... 431/142, 135, 254, 153, 155, 277, 284, 431/129, 344, 136, 139, 141
See application file for complete search history.

(56) References Cited

U.S. PATENT DOCUMENTS

| | | | | |
|---|---|---|---|---|
| 1,781,516 | A * | 11/1930 | Malkin | A63H 33/36 431/274 |
| 2,358,111 | A * | 9/1944 | Singer | F24B 15/005 431/253 |
| 5,919,037 | A | 7/1999 | Brillhart et al. | |
| 6,503,076 | B1 * | 1/2003 | Lauterbach | F23Q 2/32 431/253 |
| 8,967,899 | B1 | 3/2015 | Chu et al. | |
| 2010/0136495 | A1 | 6/2010 | Weston et al. | |

OTHER PUBLICATIONS

Ferrocerium, Wikipedia.org accessed Apr. 20, 2015.
Pyrophoricity, Wikipedia.org accessed Apr. 20, 2015.

* cited by examiner

*Primary Examiner* — Avinash Savani
*Assistant Examiner* — Rabeeul Zuberi
(74) *Attorney, Agent, or Firm* — Edward B. Weller

(57) ABSTRACT

In one embodiment, a fire starter comprises a main housing having a cavity therein. A striker is mounted on an end of the main housing and positioned to extend over at least a part of the opening of the cavity. A spark producing rod is slideably and rotatably disposed in the cavity of the main housing. A biasing element is mounted around the spark producing rod to urge a first end of the spark producing rod into contact with the striker. A torque mechanism is attached near a second end of the spark producing rod to cause rotation of spark producing rod, the second end of the spark producing rod being an end opposite the first end of the spark producing rod.

20 Claims, 15 Drawing Sheets

100

FIRE STARTERS INCLUDING ROTATING PYROPHORIC RODS

RELATED APPLICATIONS

This application claims the benefit under 35 USC § 119 to U.S. Provisional Patent Application, Ser. No. 62/218,410, filed on Sep. 14, 2015, and entitled "Fire Starters Including Rotating Pyrophoric Rods," which is incorporated by reference herein in its entirety.

BACKGROUND

The disclosure relates to fire starters, and in particular, to fire starters including rotating pyrophoric rods.

Unless otherwise indicated herein, the approaches described in this section are not admitted to be prior art by inclusion in this section.

Various fire starters are used in various environments. One such fire starter is a match that includes combustible material in a match head that ignites after striking the match head on a rough surface, such as a striker surface. However, a match that is wet may be difficult or impossible to ignite. Further, the wind may blow out a flame of the match thereby rendering the match no longer useful. A user's ability to start a fire using matches is limited by the number of matches that the user possesses. In outdoor or survival environments, carrying a large number of matches may be impractical.

Another fire starter is a lighter that includes a chamber for storing liquid fuel. A narrow channel directs vapor out of the chamber for ignition. The vapor is ignited by a spark generated by a flint member that engages a rotating metal wheel. The lighter typically generates a flame that lasts longer and is more wind resistant than a match flame, but the usefulness of the light is limited by the quantity of fuel.

Yet another fire starter is a pyrophoric device and a steel tool, such as a knife, that is moved back and forth along the length of, or struck against, the pyrophoric device to generate sparks. Such a pyrophoric device is labor intensive for generating sparks.

SUMMARY

The present disclosure provides for fire starters including rotating pyrophoric rods. In one embodiment, a fire starter comprises a main housing having a cavity therein. A striker is mounted on an end of the main housing and is positioned to extend over at least a part of the opening of the cavity. A spark producing rod is slideably and rotatably disposed in the cavity of the main housing. A torque mechanism is attached near a second end of the spark producing rod to cause rotation of the spark producing rod. The second end of the spark producing rod is at an end opposite the first end of the spark producing rod.

In one embodiment, the cavity has a cylindrical shape.

In one embodiment, the fire starter further comprises a center housing slideably and rotatably disposed in the cavity of the main housing.

In one embodiment, the spark producing rod comprises ferrucerium.

In one embodiment, the striker engages a side of the spark producing rod near the first end of the spark producing rod.

In one embodiment, the striker includes a recess to engage the first end of the spark producing rod.

In one embodiment, the striker is oriented to direct pieces of the spark producing rod in a predetermined direction.

In one embodiment, the fire starter further comprises a biasing element is mounted around the spark producing rod to urge a first end of the spark producing rod into contact with the striker.

In one embodiment, the biasing element is a spring.

In one embodiment, the torque mechanism includes a crank.

In one embodiment, the torque mechanism includes a string.

In one embodiment, the disclosure provides a method comprising: urging a pyrophoric rod into contact with a striker; and rotating the pyrophoric rod while in contact with the striker.

In one embodiment, the method further comprises orienting the striker so that sparks generated by the rotating are directed towards a combustible material.

In one embodiment, the disclosure provides for a fire starter that comprises: a housing having a cavity therein; means for generating a friction force, the means for generating a friction force is attached to the housing; means for generating a spark in response to the friction force; and means for rotating the means for generating a spark.

In one embodiment, the means for generating a spark comprises ferrucerium.

In one embodiment, the means for generating a spark comprises producing pyrophoric rod.

In one embodiment, the means for generating a friction force comprises a striker.

In one embodiment, the fire starter further comprises means for biasing the means for generating a spark into contact with the means for generating a friction force.

In one embodiment, the means for biasing is a spring.

The following detailed description and accompanying drawings provide a better understanding of the nature and advantages of the present disclosure.

BRIEF DESCRIPTION OF THE DRAWINGS

With respect to the discussion to follow and in particular to the drawings, it is stressed that the particulars shown represent examples for purposes of illustrative discussion, and are presented in the cause of providing a description of principles and conceptual aspects of the present disclosure. In this regard, no attempt is made to show implementation details beyond what is needed for a fundamental understanding of the present disclosure. The discussion to follow, in conjunction with the drawings, make apparent to those of skill in the art how embodiments in accordance with the present disclosure may be practiced. In the accompanying drawings.

DETAILED DESCRIPTION

In the following description, for purposes of explanation, numerous examples and specific details are set forth in order to provide a thorough understanding of the present disclosure. It will be evident, however, to one skilled in the art that the present disclosure as expressed in the claims may include some or all of the features in these examples, alone or in combination with other features described below, and may further include modifications and equivalents of the features and concepts described herein.

The disclosure describes fire starters that include a rotating pyrophoric rod and a fixed striker.

The fire starters described herein may provide a fire starting device that is compact, portable, and easy to operate.

The fire starters described herein may provide a fire starting device that operates outdoors in different weather, such as wind, rain, or cold.

The fire starters described herein may provide a fire starting device for starting a fire that does not depend on fuel other than what is available in the area where the fire is to be started.

In various embodiments, the fire starters described herein are field cleanable or field serviceable.

Figure 1:
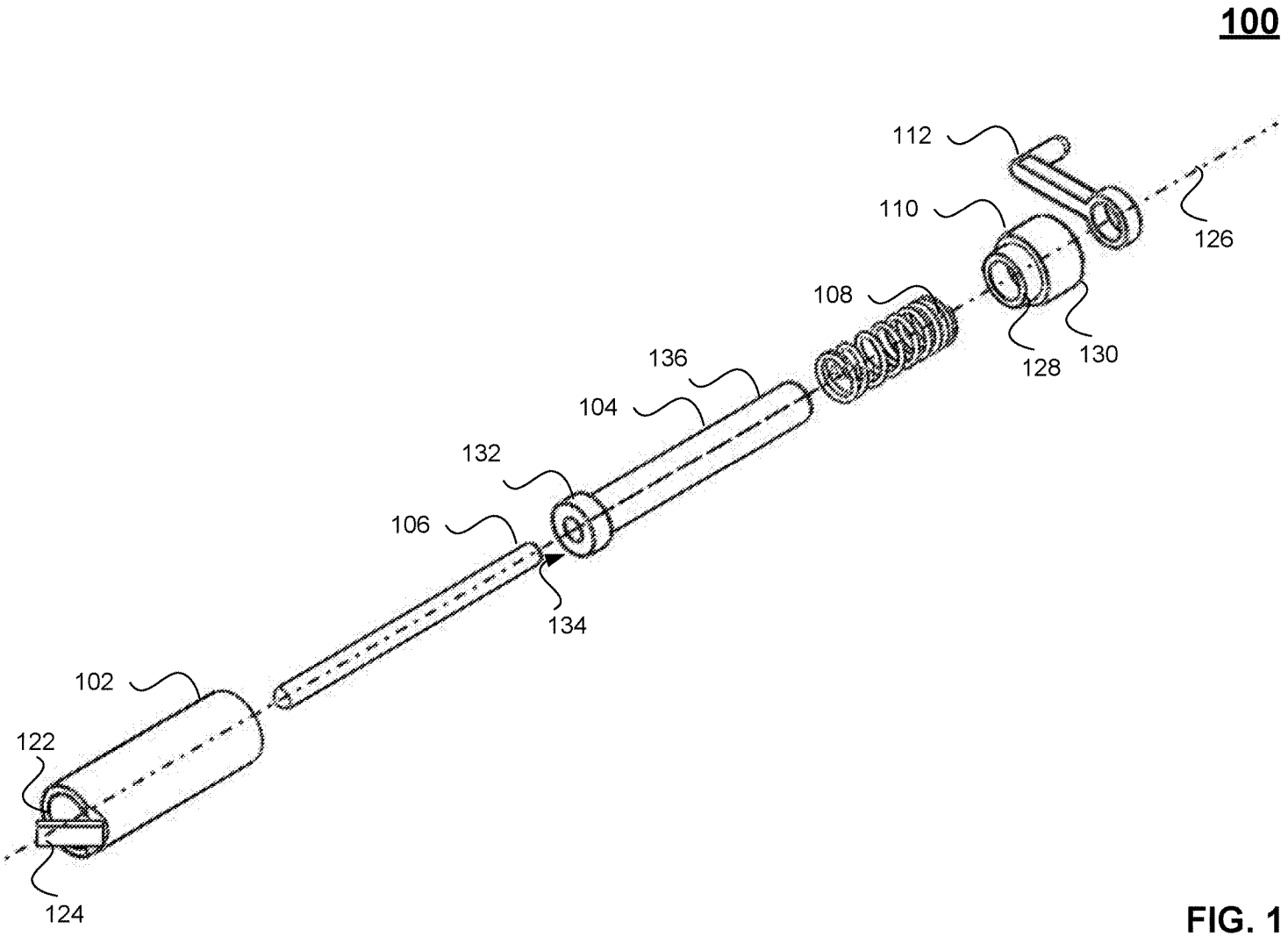
FIG. 1 is an exploded isometric view of a fire starter according to some embodiments.
Figure 2:
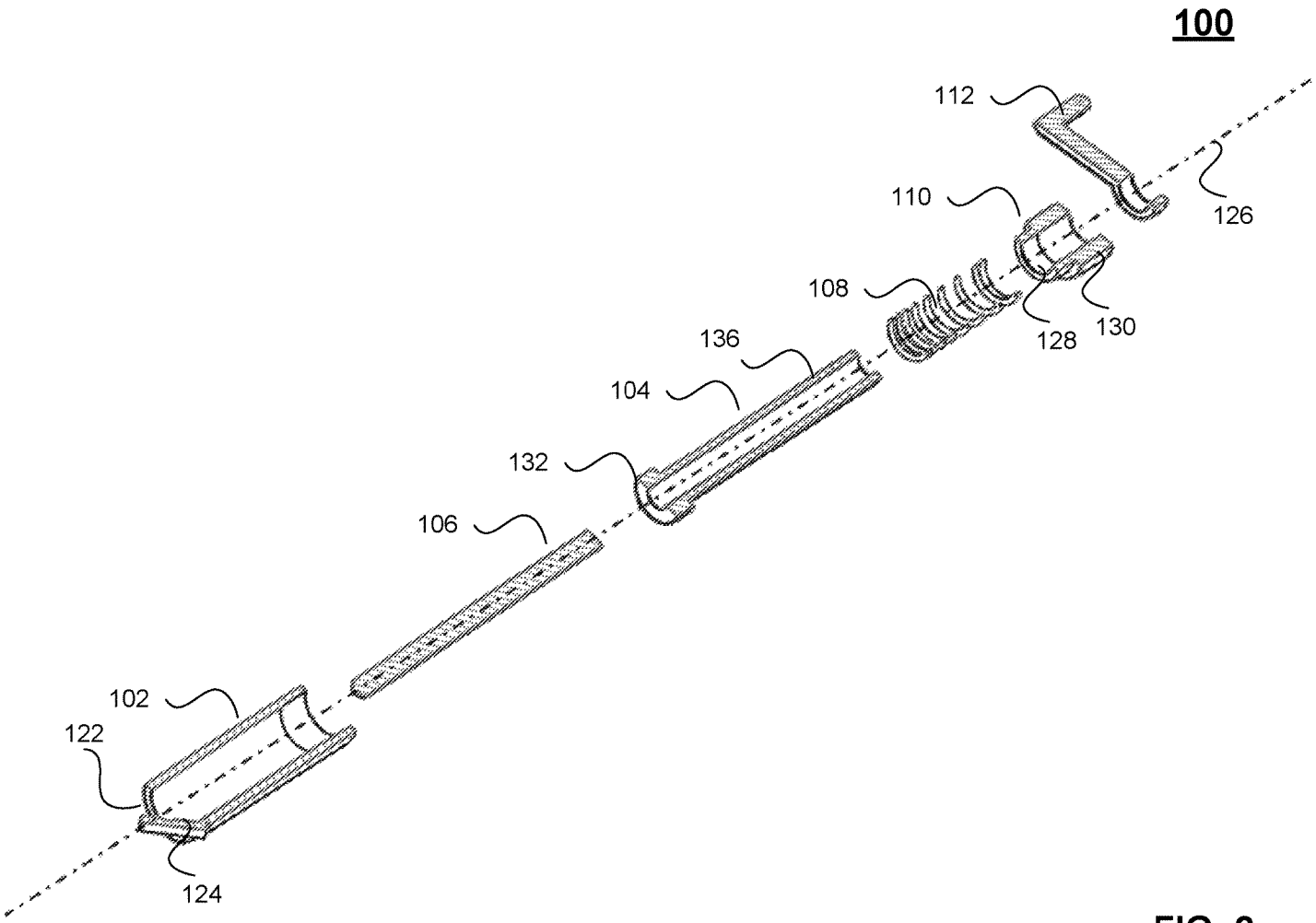
FIG. 2 is an exploded longitudinal sectional isometric view of the fire starter of FIG. 1.
Figure 3:
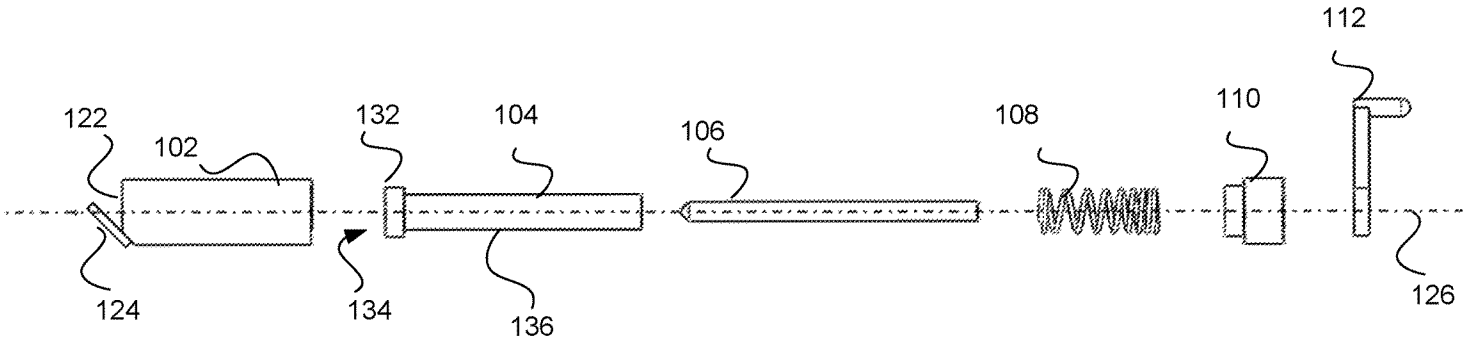
FIG. 3 is an exploded side view of the fire starter of FIG. 1.
Figure 4:
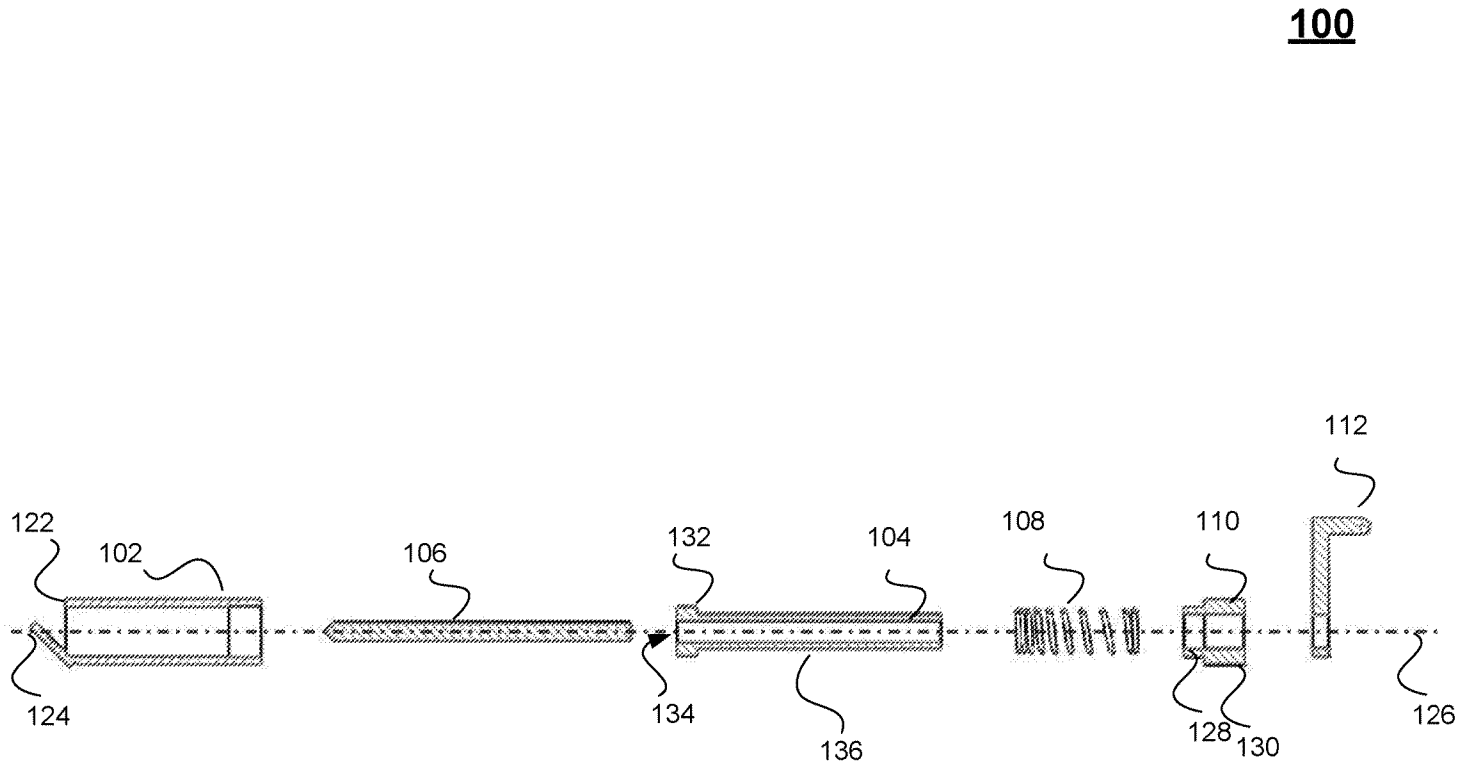
FIG. 4 is an exploded longitudinal sectional side view of the fire starter of FIG. 3.
Figure 5:
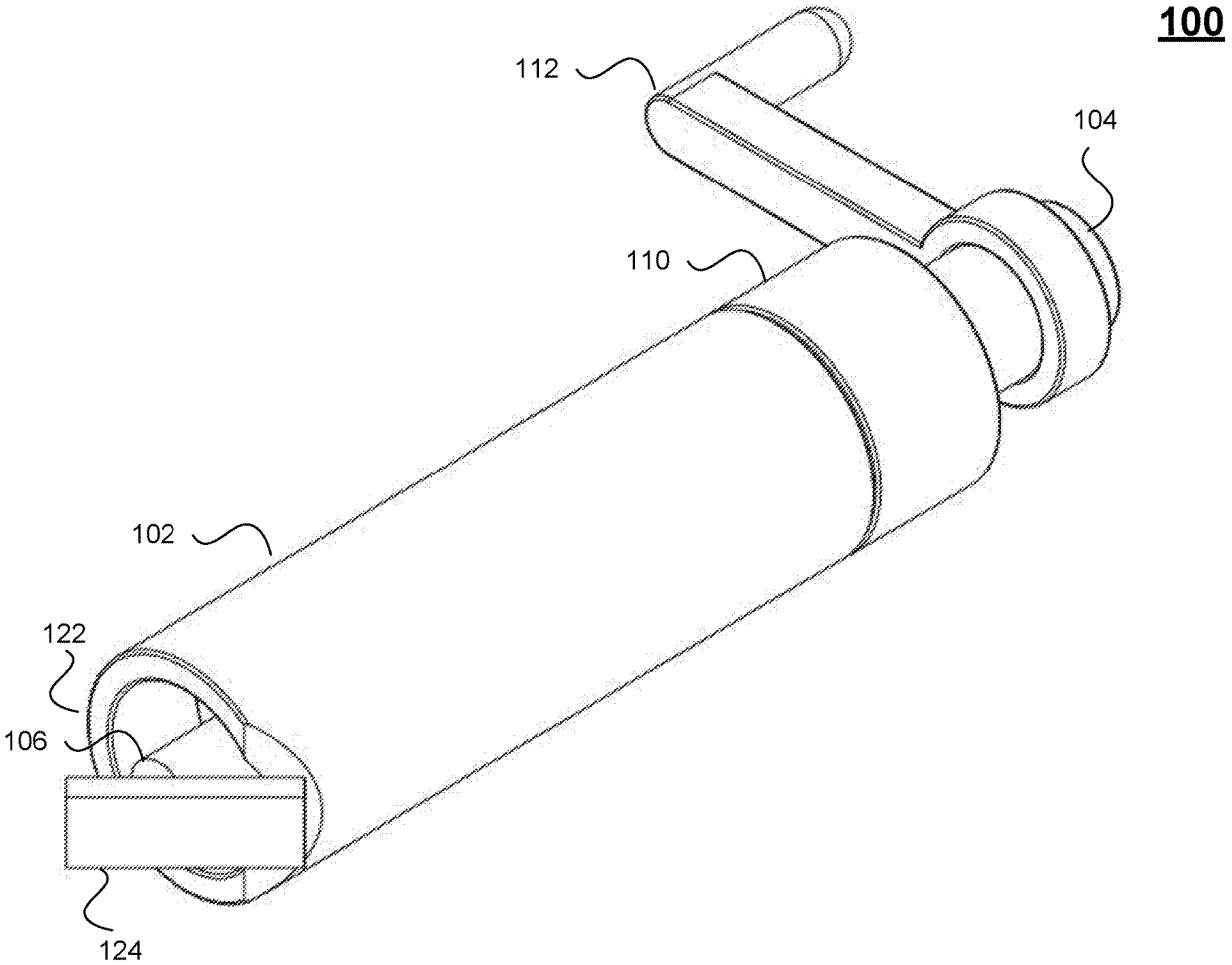
FIG. 5 is an isometric view of the fire starter of FIG. 1.
Figure 6:
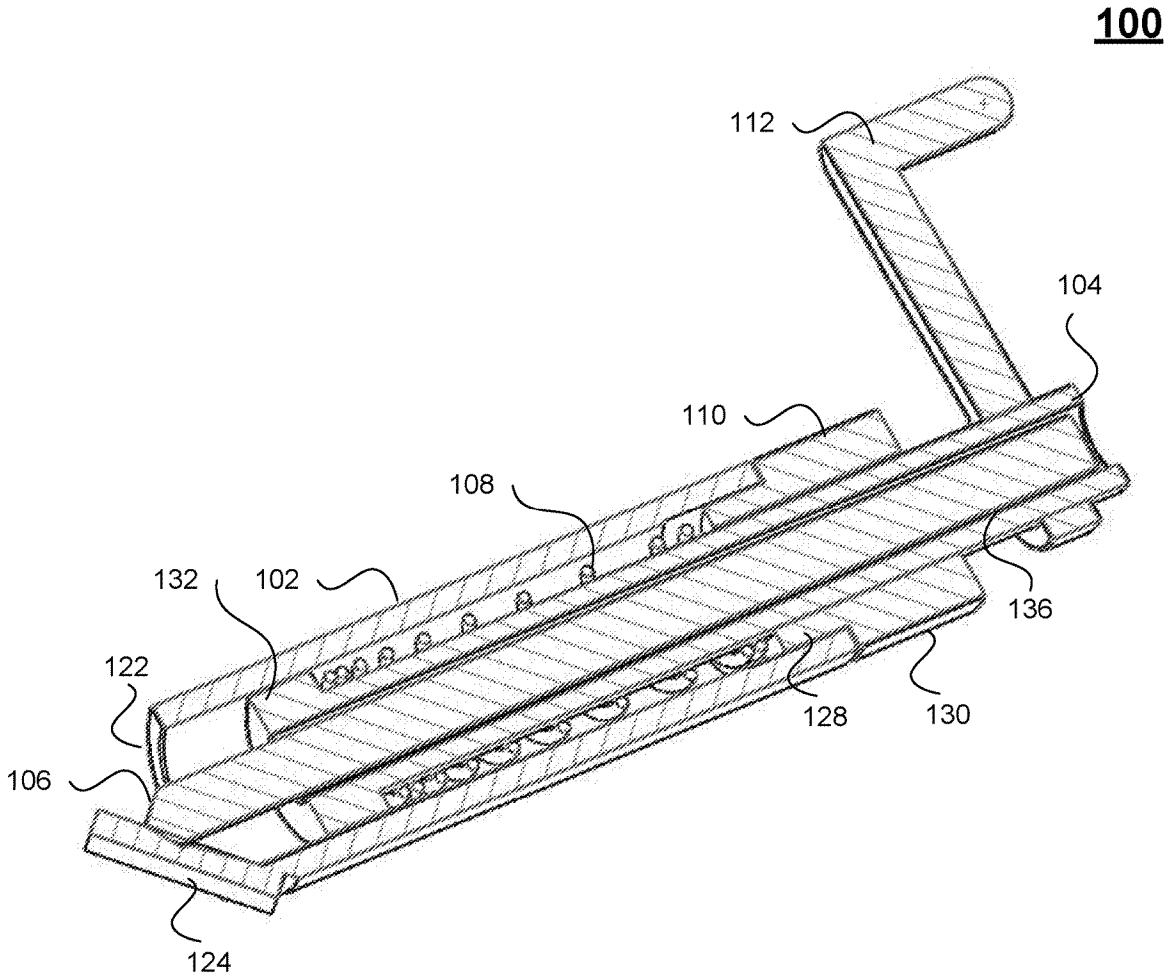
FIG. 6 is a longitudinal sectional isometric view of the fire starter of FIG. 5.
Figure 7:
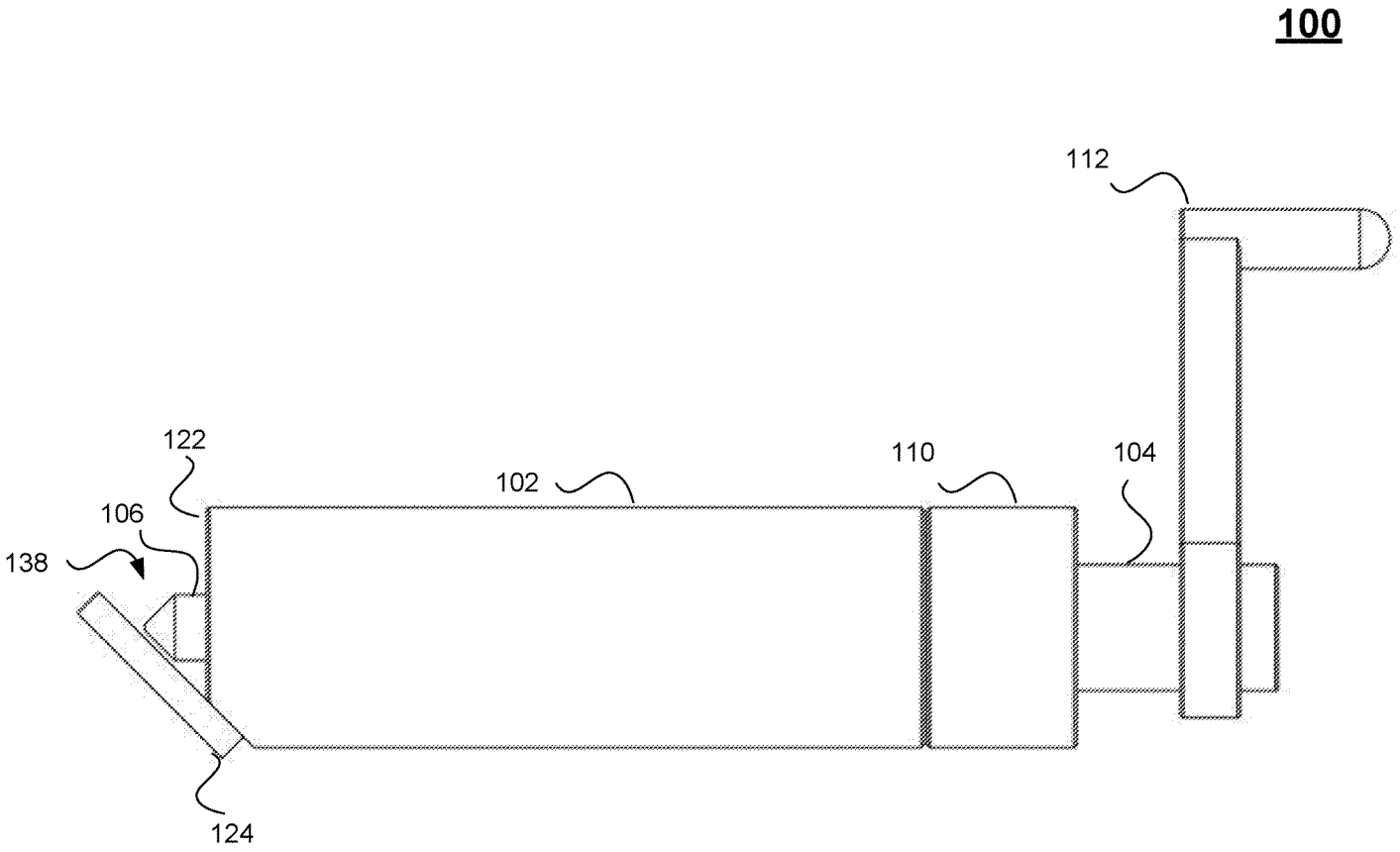
FIG. 7 is a side view of the fire starter of FIG. 1.
Figure 8:
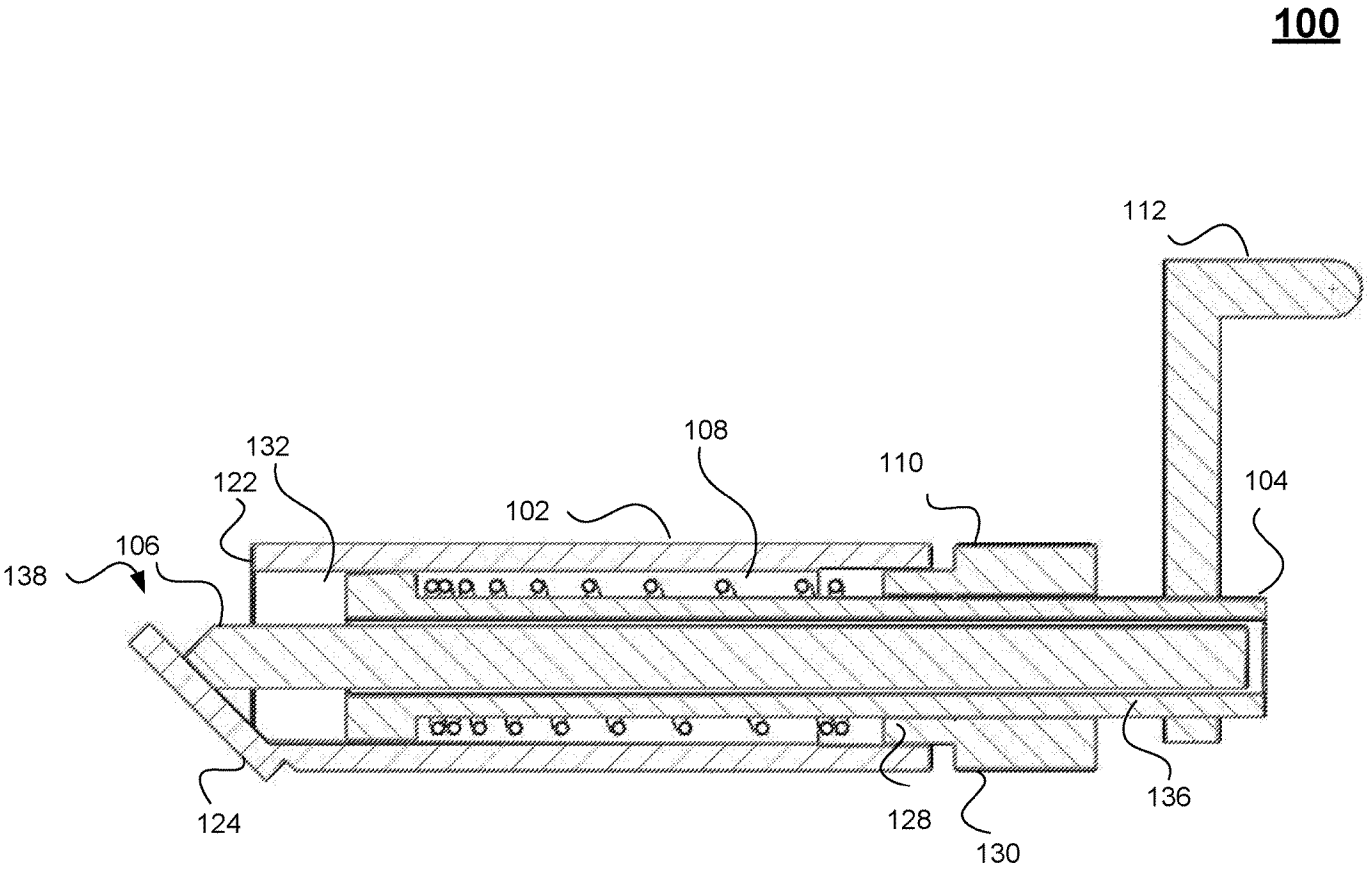
FIG. 8 is a longitudinal sectional side view of the fire starter of FIG. 7.
Figure 9:
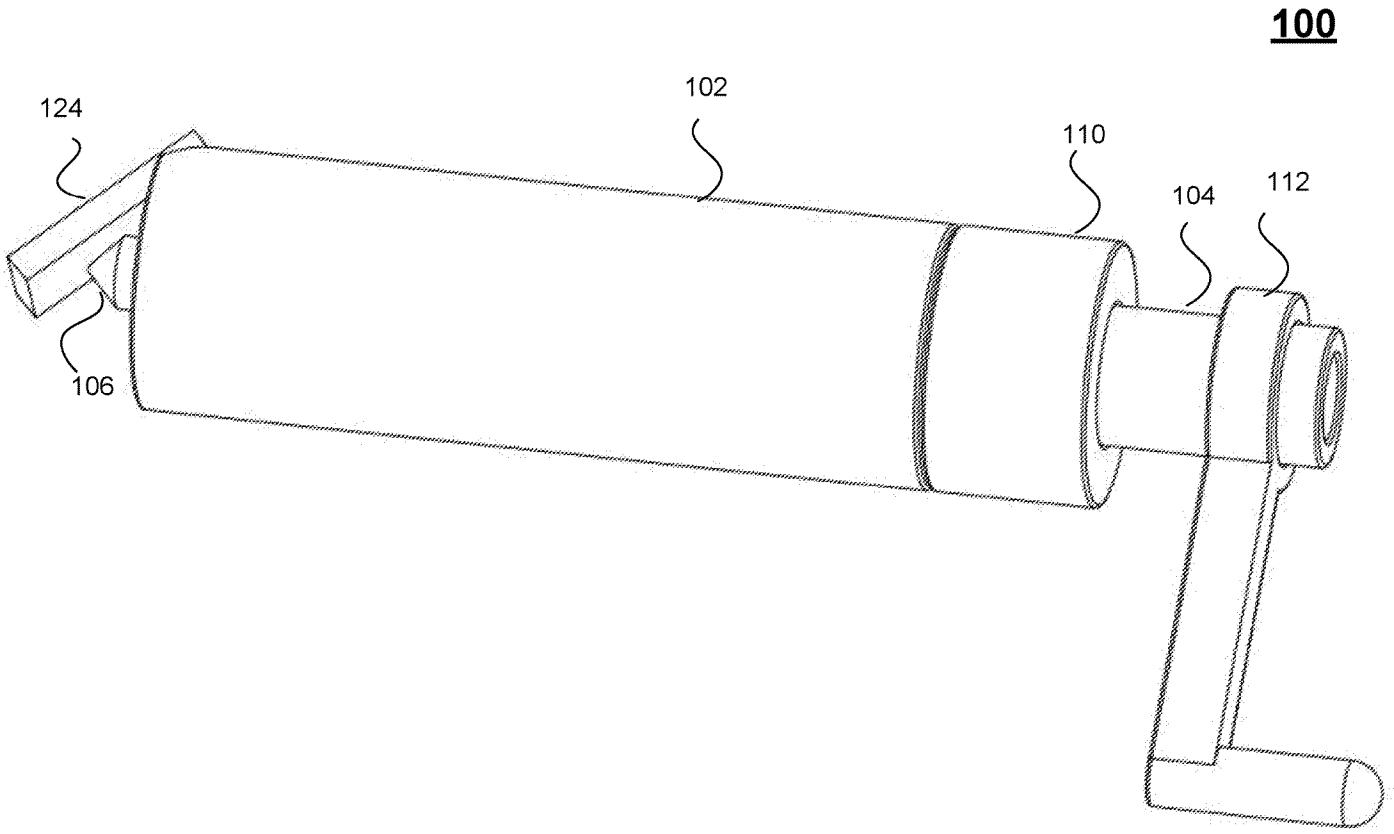
FIG. 9 is a rear isometric view of the fire starter of FIG. 5.

FIG. 1 is an exploded isometric view of a fire starter 100 according to some embodiments. FIG. 2 is an exploded longitudinal sectional isometric view of fire starter 100. FIG. 3 is an exploded side view of fire starter 100. FIG. 4 is an exploded longitudinal sectional side view of fire starter 100. FIG. 5 is an isometric view of fire starter 100. FIG. 6 is a longitudinal sectional isometric view of fire starter 100. FIG. 7 is a side view of fire starter 100. FIG. 8 is a longitudinal sectional side view of fire starter 100. FIG. 9 is a rear isometric view of fire starter 100.

Fire starter 100 comprises a main housing 102, a central housing 104, a pyrophoric rod 106, a spring 108, an end cap 110, and a crank 112.

Main housing 102 comprises a tube 122 and a striker 124. Main housing 102 may have an outside shape other than a tube, such as a rectangular parallelepiped. Central housing 104 comprises a flange 132 disposed on one end.

Main housing 102 is a cylindrical tube having a bore with an inner diameter dimensioned to accommodate flange 132 that has an outer diameter that allows central housing 104 to slide longitudinally into and out of, and rotate in, the bore of main housing 102. In some embodiments, central housing 104 has a main portion 136 that has an outer diameter that is smaller than the outer diameter than flange 132. The main portion 136 of central housing 104 is disposed in spring 108.

In various embodiments, striker 124 is fixed to main housing 102, and central housing 104 and pyrophoric rod 106 rotate within tube 122.

Central housing 104 further comprises a center bore 134 that has an inner diameter to accommodate pyrophoric rod 106 that has an outer diameter to allow pyrophoric rod 106 to slide longitudinally in center bore 134. Pyrophoric rod 106 may be attached to central housing 104, for example, by a screw (not shown) that is disposed through the wall of the flange 132 or the main portion 136 of central housing 104 to engage pyrophoric rod 106 so that pyrophoric rod 106 rotates with center bore 134 and allowing easy field replacement of pyrophoric rod 106.

Striker 124 may include a flat elongated plate that contacts pyrophoric rod 106 to generate a spark in response to the contact and friction therebetween. In some embodiments, striker 124 may be pivotable to increase or maximize contact area for a selected angle 138 between striker 124 and pyrophoric rod 106, to thereby increase or maximize spark output.

In some embodiments, striker 124 includes a file like surface (such as teeth) that contacts pyrophoric rod 106.

In some embodiments, striker 124 may be removably attached to tube 122 of main housing 102. This may allow striker 124 to be replaced due to wear or for ease of cleaning.

Central housing 104 includes a flange 132 that engages the inner surface of tube 122 to hold central housing 104 and pyrophoric rod 106 to rotate about a longitudinal axis 134 of tube 122.

In some embodiments, flange 132 is separate from central housing 104.

The angle 138 that striker 124 contacts pyrophoric rod 106 can be, between zero and ninety degrees.

Pyrophoric rod 106 is disposed in central housing 104 and protrudes outwardly from flange 132. Pyrophoric rod 106 may be affixed to central housing 104 so that both central housing 104 and pyrophoric rod 106 rotate together. In some embodiments, pyrophoric rod 106 has a cylindrical shape. In various embodiments, pyrophoric rod 106 has other shapes, such as rectangular parallelepiped.

Spring 108 is a biasing mechanism that urges pyrophoric rod 106 towards and into contact with striker 124. Spring 108 holds pyrophoric rod 106 in contact with striker 124 to maintain a pressure on the pyrophoric rod 106 during use and non-use of fire starter 100. In some embodiments, pressure may be maintained by hand, such as pushing down on crank 112 instead of or in addition to spring 108. In some embodiments, central housing 104 is pushed by hand so that pyrophoric rod 106 is urged into striker 124, and fire starter 100 includes a mechanism to rotate the central housing 104 and pyrophoric rod 106 in response to the pushing. In some embodiments, fire starter 100 is configured so that pyrophoric rod 106 may be retracted away from striker 124 during non-use.

End cap 110 has a center bore with an inner diameter dimensioned to accommodate main portion 136 of central housing 104 that has an outer diameter to allow central housing 104 to slide longitudinally in the center bore of end cap 110. End cap 110 may include threads that engage threads in tube 122 to allow end cap 110 to be removably attached to main housing 102. In various embodiments, one end of the center bore of main housing 102 may be threaded in the center bore that has threads (not shown) on a portion of the inner surface of tube 122 at the end of tube 122 opposite striker 124. Cap 110 comprises a body 128 having threads (not shown) disposed on a portion of the outer surface and further comprises a shoulder 130 disposed on body 128. Body 128 has an outer diameter less than the outer diameter of shoulder 130 and that is sized to be insertable into the bore of main housing 102 to threadably engage tube 122. After such attachment, end cap 110 holds central housing 104 in the center bore of main housing 102.

Crank 112 is mounted to central housing 104 and is a torque mechanism for rotating central housing 104 and thereby rotating pyrophoric rod 106. In some embodiments, crank 112 is removable or foldable, or both.

In some embodiments, fire starter 100 does not include a crank 112. Central housing 104 may include a mechanism to which a string or the like is attached and wound around the outer surface of central housing 104. The string may be pulled to provide torque and thereby cause central housing 104 and pyrophoric rod 106 to rotate. In some embodiments, crank 112 or the torque mechanism is rotatable in one direction. In some embodiments, crank 112 or the torque mechanism is rotatable in both directions.

Main housing 102 has a center longitudinal axis 126. Central housing 104 and pyrophoric rod 106 each have a center longitudinal axis 126 that is aligned on center longitudinal axis 126 while disposed in main housing 102. Crank 112 is configured to provide torque to pyrophoric rod 106 and central housing 104 along center longitudinal axis 126 so that pyrophoric rod 106 and central housing 104 rotate about center longitudinal axis 126.

Main housing 102 (except for striker 124), central housing 104, spring 108, end cap 110, and crank 112 may be formed of any material that is sufficiently strong for the support and rotation forces and torques applied thereto. For example, such materials include hard metal (such as aluminum or titanium), or a hardened plastic. In some embodiments, pyrophoric rod 106 is formed of a pyrophoric material, such as Ferrocerium, or other material that is capable of generating sparks. In various embodiments, striker 124 is formed of a material, such as steel, that causes pyrophoric rod 106 to generate sparks in response to contact and relative movement of pyrophoric rod 106 and striker 124.

Fire starter 100 may include a cap (not shown) to cover the tip of pyrophoric rod 106, striker 124, and tube 122 during non-operation periods of fire starter 100. The cap may keep dirt and other debris off of the tip of pyrophoric rod 106, striker 124, and tube 122, and to disengage pyrophoric rod 106 from contacting striker 124 to prevent accidental sparking from igniting a fire.

The assembly of fire starter 100 is next described.

Pyrophoric rod 106 is inserted into bore 134 of central housing 104 so that one end of pyrophoric rod 106 extends beyond flange 132. Pyrophoric rod 106 is secured to central housing 104 by a screw or other attachment or securing mechanism (not shown). Central housing 104 is inserted into the center portion of spring 108. Thus, central housing 104, pyrophoric rod 106, and spring 108 are inserted into the bore of main housing 102 on the flange 132 end of central housing 104 until pyrophoric rod 106 contacts striker 124. End cap 110 is inserted over the central housing 104 into the threaded end of main housing 102 and rotated to secure end cap 110 to main housing 102. Crank 112 is attached to the end of central housing 104 opposite flange 132 for use and operation of fire starter 100.

The use and operation of fire starter 100 is next described.

The user assembles a pile of dry combustible material that may include for example, kindling or other material that is relatively easily ignitable by sparks and material that is suitable for larger fires upon the ignition of the kindling.

The user holds main housing 102 with one hand, and grabs crank 112 with the other hand. The user places fire starter 100 so that the tip of pyrophoric rod 106 and striker 124 near the kindling such that sparks generated by striker 124 and pyrophoric rod 106 are likely to impinge on and thereby ignite the kindling. The user rotates crank 112 to thereby rotate pyrophoric rod 106 and generate sparks. After the kindling ignites from the sparks, the user moves fire starter 100 away from the kindling. As needed, the user may blow on, fan, or otherwise control airflow to the kindling for controlling the ignition of the kindling.

Figure 10:
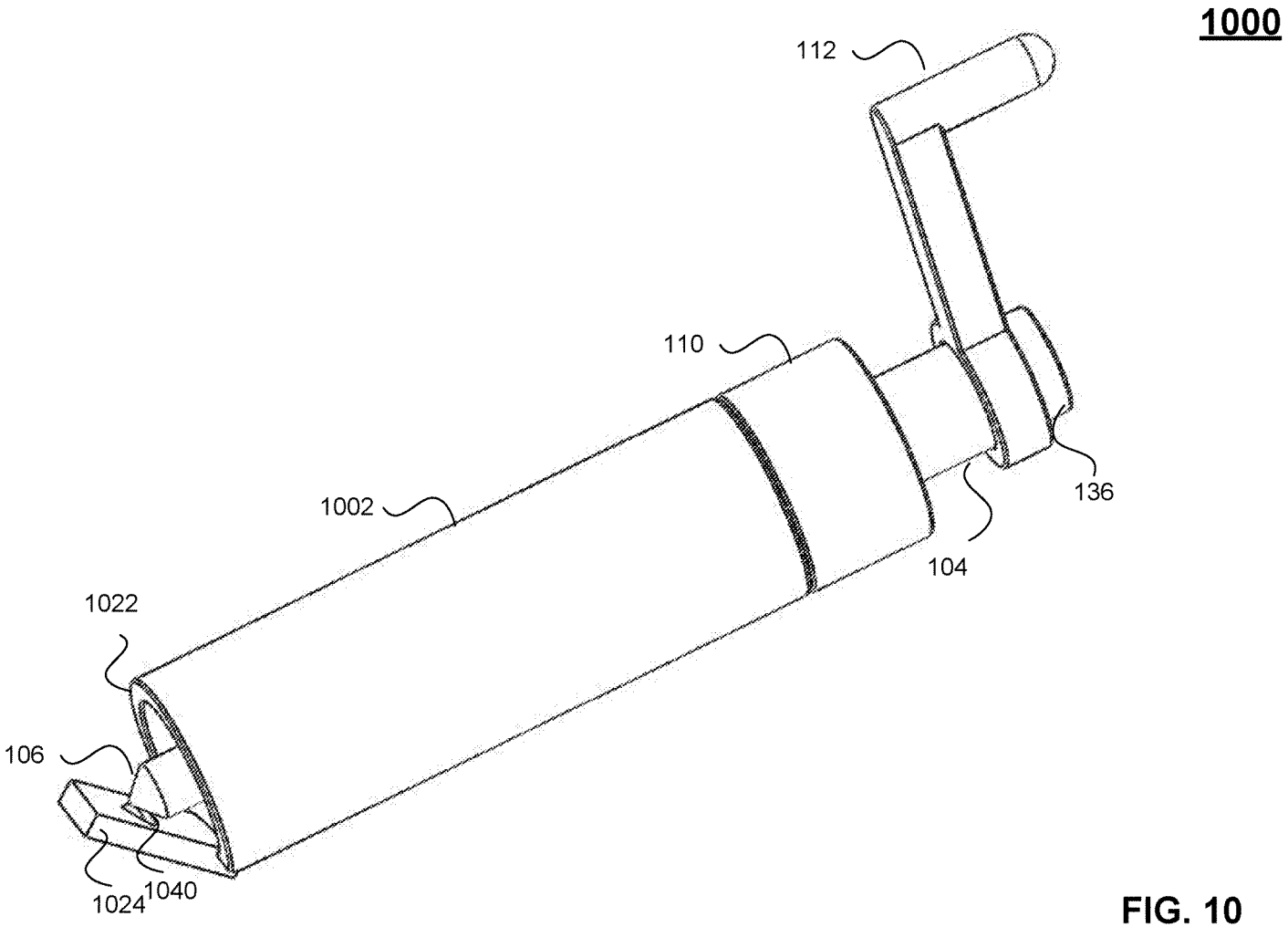
FIG. 10 is an isometric view of a fire starter according to some other embodiments.
Figure 11:
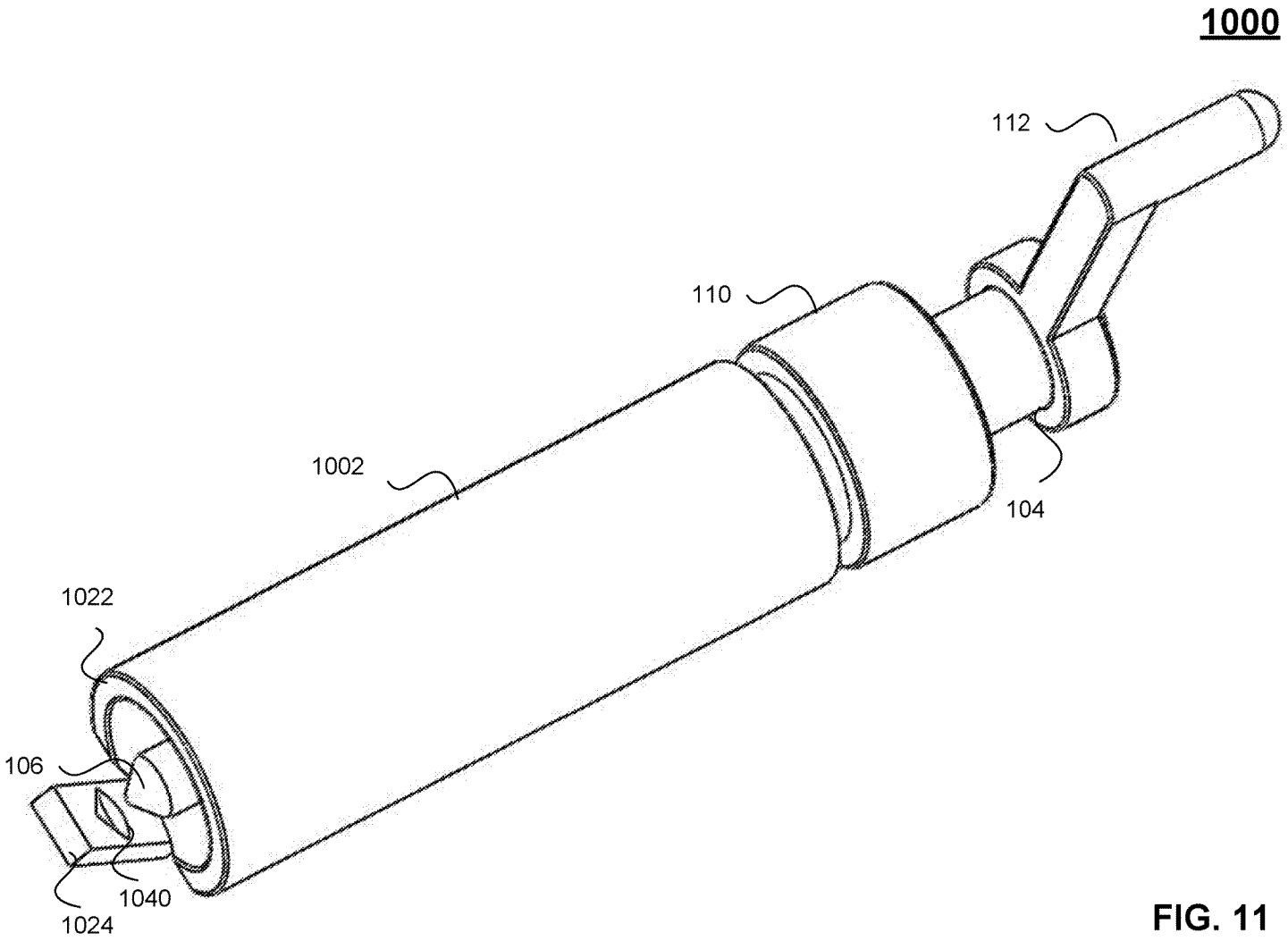
FIG. 11 is another isometric view of the fire starter of FIG. 10.
Figure 12:
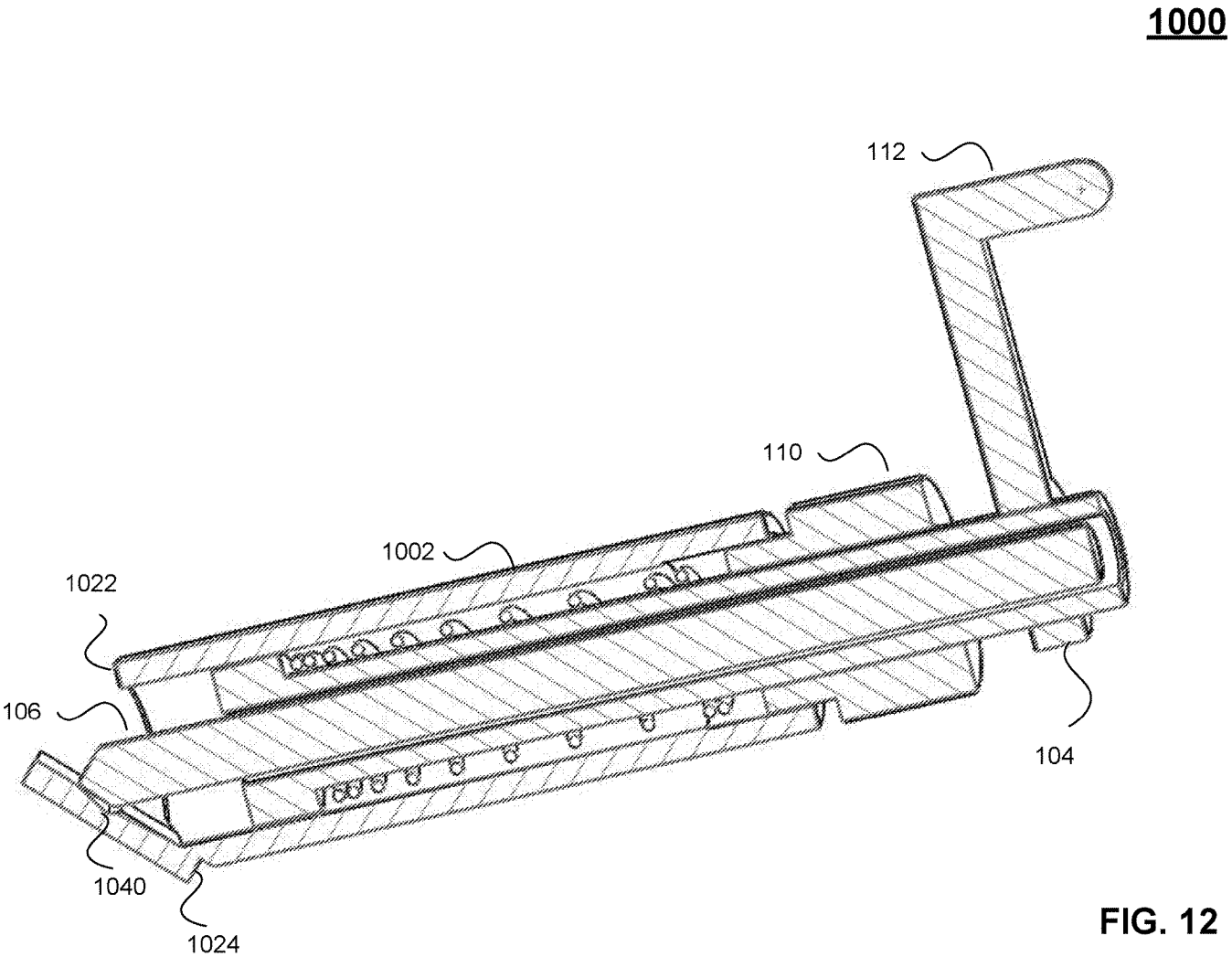
FIG. 12 is a longitudinal sectional isometric view of the fire starter of FIG. 10.
Figure 13:
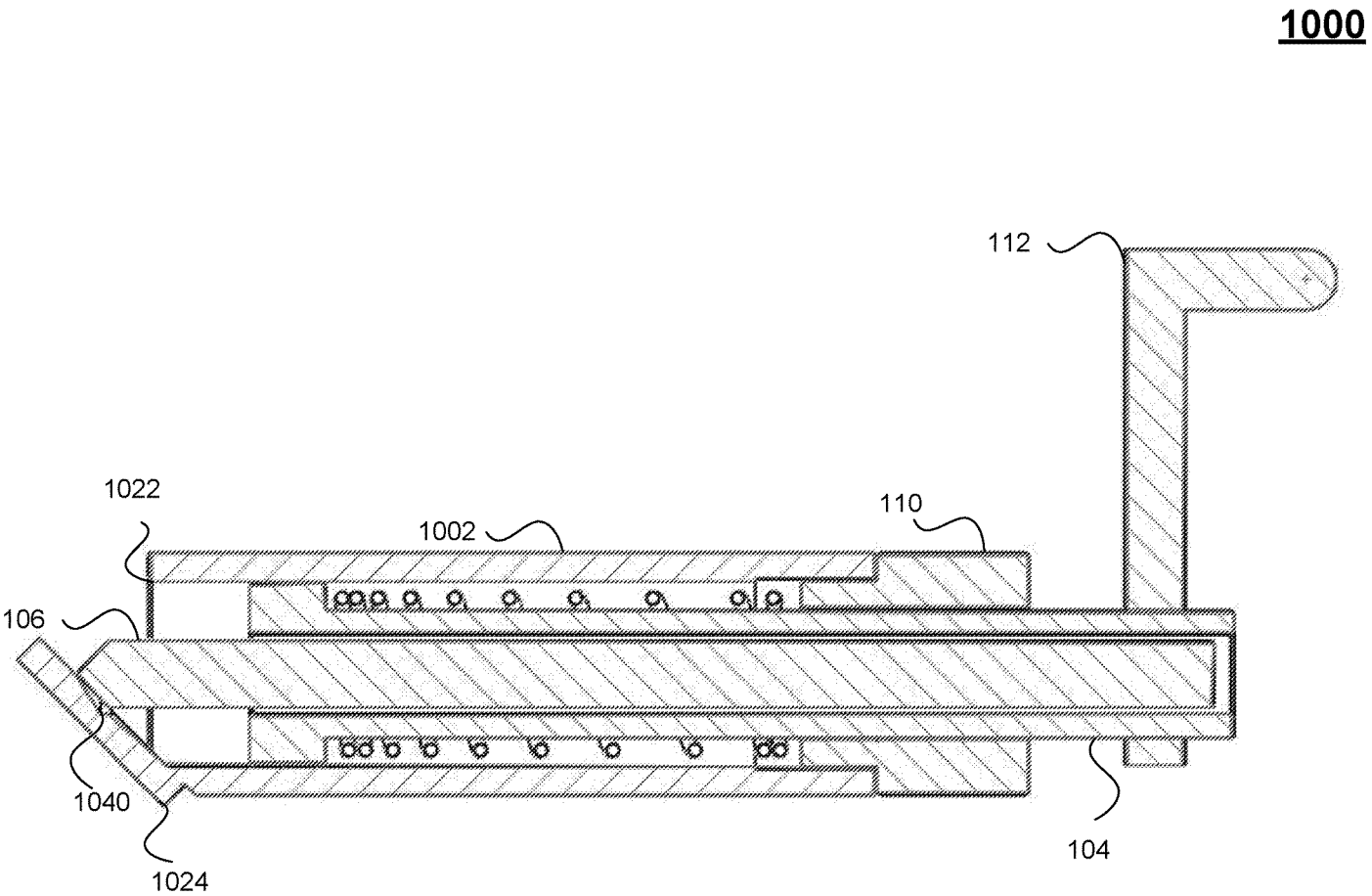
FIG. 13 is a longitudinal sectional side view of the fire starter of FIG. 10.

FIG. 10 is an isometric view of a fire starter 1000 according to some other embodiments. FIG. 11 is another isometric view of fire starter 1000. FIG. 12 is a longitudinal sectional isometric view of fire starter 1000. FIG. 13 is a longitudinal sectional side view of fire starter 1000.

Fire starter 1000 is similar fire starter 100, but includes a main housing 1002 instead of main housing 102. Main housing 1002 comprises a tube 1022 that is similar to tube 122 and a striker 1024. Striker 1024 is similar to striker 124, but further includes a recess 1040, depression, or concave surface. Recess 1040 may be, for example, an indentation, depression, or concave surface in striker 1024 that provides a larger contact area with pyrophoric rod 106.

Fire starter 1000 is assembled and operated in a similar manner as fire starter 100.

Fire starter 100 and fire starter 1000 may be dimensioned for carrying as a camping tool or survival tool.

Fire starter 100 and fire starter 1000 may be dimensioned so that main housings 102 and 1002, respectively, are easy to grip in one hand and hold near a combustible material, and the torque mechanism is easy to engage (such as crank 112) in the other hand to rotate pyrophoric rod 106 at a sufficient angular rotation to cause pyrophoric rod 106 to generate sparks.

Figure 14:
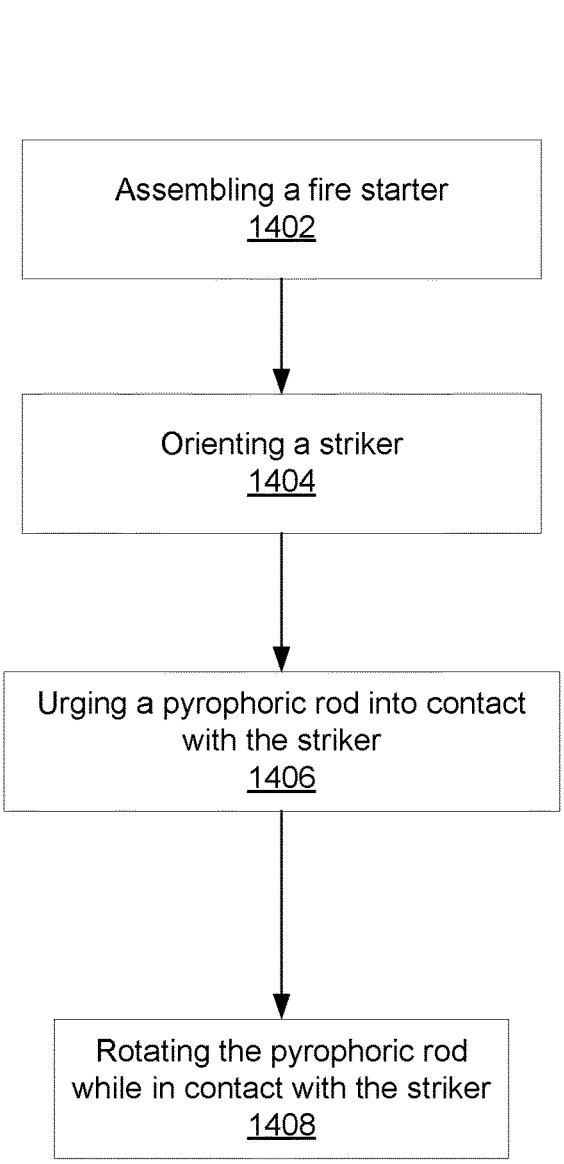
FIG. 14 is a process flow diagram illustrating a process flow of a fire starter according to some embodiments.

FIG. 14 is a process flow diagram illustrating a process flow 1400 of a fire starter according to some embodiments. Process flow 1400 is described for fire starter 100, but can be used for fire starter 1000.

At 1402, fire starter 100 is assembled (such as described above). At 1404, striker 124 is oriented so that sparks generated by pyrophoric rod 106 are directed towards a combustible material. At 1406, pyrophoric rod 106 is urged into contact with striker 124, in embodiments in which fire starter 100 does not include a biasing mechanism and the contact may done by hand. In embodiments in which fire starter 100 includes spring 108, the contact between pyrophoric rod 106 and striker 124 occurs as part of assembly at 1402. At 1408, pyrophoric rod 106 is rotated while in contact with striker 124.

Figure 15:
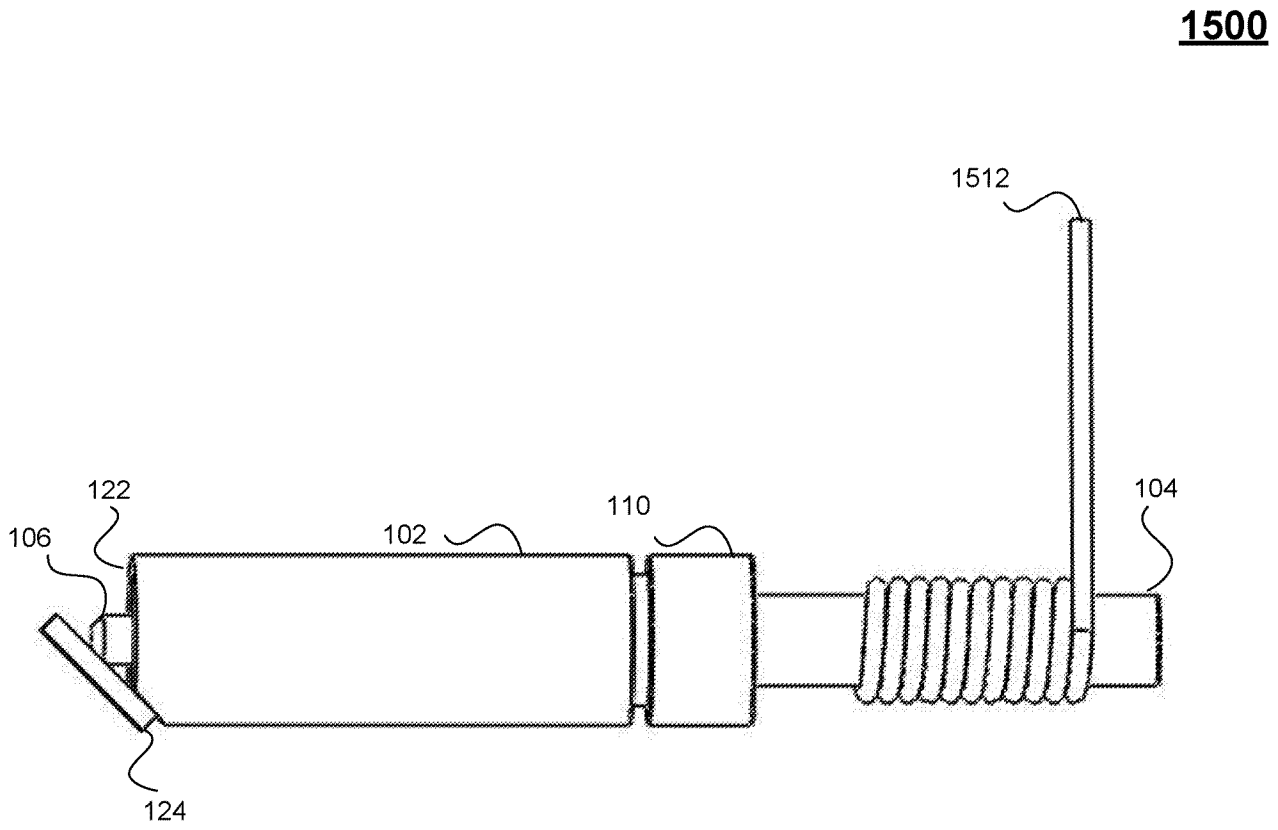
FIG. 15 is a side view of a fire starter according to yet another embodiment.

FIG. 15 is a side view of a fire starter 1500 according to yet another embodiment. Fire starter 1500 is similar to fire starter 100, but includes a string 1512 wrapped around the central housing 104 and does not include a crank 112. Central housing 104 may include a mechanism (not shown) to which the string 1512 is attached and wound around the outer surface of central housing 104. The string 1512 may be pulled to provide torque and thereby cause central housing 104 and pyrophoric rod 106 to rotate about a longitudinal axis and in to the main housing 102 and the striker 124.

REFERENCE NUMBERS

100 fire starter
102 housing
104 central housing
106 pyrophoric rod
108 spring
110 end cap
112 crank
122 tube
124 striker
126 longitudinal axis
128 body

130 shoulder
132 Flange
134 center bore
136 main portion (of 104)
1000 fire starter
1002 Main housing
1022 tube
1024 Striker
1040 recess
1512 string The above description illustrates various embodiments of the present disclosure along with examples of how aspects of the particular embodiments may be implemented. The above examples should not be deemed to be the only embodiments, and are presented to illustrate the flexibility and advantages of the particular embodiments as defined by the following claims. Based on the above disclosure and the following claims, other arrangements, embodiments, implementations and equivalents may be employed without departing from the scope of the present disclosure as defined by the claims.

What is claimed is:

1. A fire starter comprising:

a main housing having a cavity therein and having a center longitudinal axis;

a striker mounted on an end of the main housing and positioned to extend over at least a part of the opening of the cavity;

a spark producing rod disposed in the cavity of the main housing and slideable along the center longitudinal axis to engage the striker at a first end of the spark producing rod and rotable about the center longitudinal axis; and a torque mechanism attached near a second end of the spark producing rod to cause rotation of the spark producing rod about the center longitudinal axis, the second end of the spark producing rod being at an end opposite the first end of the spark producing rod.

2. The fire starter of claim 1, wherein the cavity has a cylindrical shape along the center longitudinal axis.

3. The fire starter of claim 1, further comprising a central housing slideably and rotatably disposed in the cavity of the main housing, the spark producing rod being disposed in the central housing and is slideable and rotatable with the central housing.

4. The fire starter of claim 1, wherein the spark producing rod comprises ferrucerium.

5. The fire starter of claim 1, wherein a side of the spark producing rod near the first end of the spark producing rod engages the striker.

6. The fire starter of claim 1, wherein the striker includes a recess to engage the first end of the spark producing rod.

7. The fire starter of claim 1, wherein the striker is oriented to direct pieces of the spark producing rod in a predetermined direction towards a location spaced apart from the fire starter.

8. The fire starter of claim 1, further comprising a biasing element mounted around the spark producing rod to urge along the central longitudinal axis the first end of the spark producing rod into contact with the striker.

9. The fire starter of claim 3, wherein the biasing element is a spring mounted around the central housing.

10. The fire starter of claim 1, wherein the torque mechanism includes a crank.

11. The fire starter of claim 1, wherein the torque mechanism includes a string.

12. A method for using a fire starter, the fire starter comprising a pyrophoric rod and a striker, the method comprising:

urging the pyrophoric rod from a cavity of the fire starter into contact with the striker; and rotating the pyrophoric rod while in contact with the striker.

13. The method of claim 12 wherein further comprising:

placing the striker near a combustible material before or during said rotating; and orienting the striker so that sparks generated by the rotating pyrophoric rod contact the combustible material.

14. A fire starter comprising:

a housing having a cavity therein;

means for generating a friction force, the means for generating a friction force is attached to the housing;

means for generating a spark in response to the friction force, the means for generating a spark being disposed at least partially in the cavity and rotatable and slideable in the cavity; and means for rotating the means for generating a spark against the means for generating a friction force.

15. The fire starter of claim 14, wherein the cavity has a cylindrical shape.

16. The fire starter of claim 14, wherein the means for generating a spark comprises ferrucerium.

17. The fire starter of claim 14, wherein the means for generating a spark comprises a pyrophoric rod.

18. The fire starter of claim 17, wherein the means for generating a friction force comprises a striker.

19. The fire starter of claim 17, further comprising means for biasing the means for generating a spark into contact with the means for generating a friction force.

20. The fire starter of claim 19, wherein the means for biasing is a spring.

* * * * *